US006755980B1

(12) United States Patent
Van Den Born et al.

(10) Patent No.: US 6,755,980 B1
(45) Date of Patent: Jun. 29, 2004

(54) PROCESS TO REMOVE SOLID SLAG PARTICLES FROM A MIXTURE OF SOLID SLAG PARTICLES AND WATER

(75) Inventors: Isaac Cornelis Van Den Born, Amsterdam (NL); Johannes Gerardus Maria Schilder, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/089,028

(22) PCT Filed: Sep. 20, 2000

(86) PCT No.: PCT/EP00/09254

§ 371 (c)(1),
(2), (4) Date: Mar. 26, 2002

(87) PCT Pub. No.: WO01/21736

PCT Pub. Date: Mar. 29, 2001

(51) Int. Cl.[7] ..... B01D 37/00

(52) U.S. Cl. ..... 210/767; 210/803; 414/217; 414/221

(58) Field of Search ..... 210/767, 768, 210/770, 803, 805; 414/217, 221

(56) References Cited

U.S. PATENT DOCUMENTS 4,401,402 A * 8/1983 Casperson
4,728,250 A * 3/1988 Wilhelm et al.
4,755,190 A * 7/1988 Harris
4,790,251 A * 12/1988 Vidt

FOREIGN PATENT DOCUMENTS

| | | | |
|---|---|---|---|
| EP | 0 113 469 | 7/1984 | ..... C10J/3/46 |
| EP | 0 290 087 | 11/1988 | ..... C10J/3/46 |
| GB | 2 026 145 | 1/1980 | ..... F23J/1/00 |
| GB | 2 086 921 | 5/1982 | ..... C10J/3/00 |
| JP | 10 28/886 | 10/1998 | ..... C10J/3/46 |

* cited by examiner

*Primary Examiner*—Robert Popovics

(57) ABSTRACT

Process to remove solid slag particles from a mixture of solid slag particles and water present in a quench zone, which quench zone is part of a process for the preparation of synthesis gas by partial combustion of finely dispersed solid carbon-containing fuel with an oxygen-containing gas, by a) discharging of the mixture from the quench zone to a first vessel, (b) discharging slag particles from the first vessel to a second vessel and discharging water poor in solid slag from a second vessel, which second vessel is located below and fluidly connected to said first vessel by means of an open connecting conduit provided with pumping means and is further provided with closed means to discharge slag from its lower end, (c) fluidly closing the first vessel from the second vessel, (d) opening of the means to discharge slag from the second vessel to remove slag from the second vessel to a lower pressure zone, and (e) closing the means to discharge slag from the second vessel and repeating steps (a) to (e).

10 Claims, 1 Drawing Sheet

Figure 1:
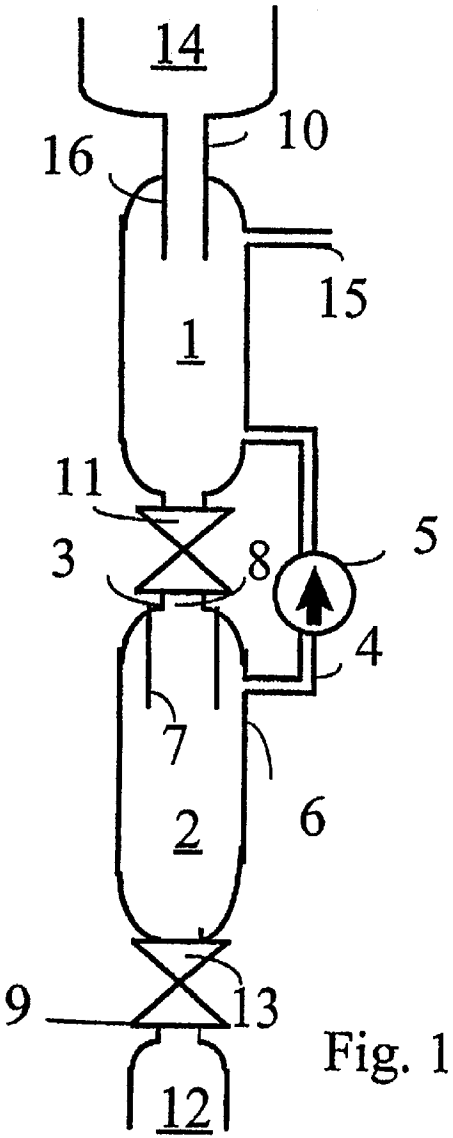

PROCESS TO REMOVE SOLID SLAG PARTICLES FROM A MIXTURE OF SOLID SLAG PARTICLES AND WATER

The present invention is directed to a process to remove solid slag from a mixture of solid slag and water present in a quench zone, which quench zone is part of a process for the preparation of synthesis gas by partial combustion of finely dispersed solid carbon-containing fuel with an oxygen-containing gas. Such a process is described in EP-A-290087. In this process a mixture of water and solid slag is batchwise sluiced out of a pressurized gasification system. Liquid slag is a by-product of the gasification or partial combustion of, for example, coal. Liquid slag is drained through the outlet located at the reactor bottom and passed by gravity through a slag discharge means into a water bath or slag quenching vessel where the mixture of water and solid slag particles are formed. The batchwise sluicing of the mixture from the pressurized gasification system to a lower-pressure discharge zone is performed by means of a lock-hopper. During the sluicing cycle the lockhopper is isolated from the gasification system by closing one or more valves in the connecting line between the slag quench vessel and the lockhopper.

A problem of this sluicing procedure is that, when the valve between the lockhopper and the quench vessel is closed, the slag accumulating up-stream this valve has a tendency for bridging at the narrow space just above the said valve. It has appeared very difficult to have the slag to fall into the lockhopper after reconnecting the lockhopper to the gasification system. This problem is solved by the process disclosed in EP-A-290087, wherein a permanent nitrogen-gas bubble or nitrogen-gas cap is maintained in the lock-hopper. By ensuring that the pressure of the said nitrogen gas bubble is lower than the pressure in the slag quench vessel an initial downwards flow of water and slag during opening of the valves between the lockhopper and the slag quench vessel is achieved. This method also results in a quick discharge of the slag from the quench vessel into the lockhopper.

Although the above process has proven to work satisfactory in commercial practice it still has some disadvantages. One disadvantage is the need to install additional equipment to supply nitrogen and the associated costs of the nitrogen consumption during every sluicing cycle. A further disadvantage is that together with the discharged mixture an amount of sulphur compounds, of which hydrogen sulphide is the most prominent, and other dissolved components, for example ammonia, chloride and carbon monoxide, are also discharged. Hydrogen sulphide is formed in the reactor from sulphur containing compounds which are present in the hydrocarbon feed. Part of the hydrogen sulphide will dissolve in the water present in the slag quench vessel and will thus be discharged together with the slag in the above described process.

The object of the present invention is a simple process to quickly separate solid slag particles from a quench zone, containing a mixture of said slag particles and water, such that no or very little sulphur containing compounds are being removed with the slag from the quench zone.

This object is achieved by the following process. Process to remove solid slag particles from a mixture of solid slag particles and water present in a quench zone, which quench zone is part of a process for the preparation of synthesis gas by partial combustion of finely dispersed solid carbon-containing fuel with oxygen-containing gas, by (a) discharging of the mixture from the quench zone to a first vessel, (b) discharging slag particles from the first vessel to a second vessel by means of gravity, which second vessel is located below and fluidly connected to said first vessel by means of an open connecting conduit and is further provided with closed means to discharge slag from its lower end, and discharging water poor in solid slag from the second vessel via a conduit provided with. pumping means and having an inlet located such that water poor in slag particles are pumped from the second vessel, (c) fluidly closing the first vessel from the second vessel, (d) opening of the means to discharge slag from the second vessel to remove slag from the second vessel to a lower pressure zone, and (e) closing the means to discharge slag from the second vessel and repeating steps (a) to (e).

By performing the process according the invention it is possible to discharge solid slag particles from a vessel containing a mixture of liquid and solid slag particles, wherein the amount of sulphur containing compounds being discharged together with the water is lower than in prior art processes. Less hydrogen sulphide will thus be discharged together with the slag particles. The hydrogen sulphide normally discharged together with the slag will now be discharged with the synthesis product gases. Because the synthesis gases typically contain a certain amount of hydrogen sulphide it will be no problem to remove this additional amount of hydrogen sulphide in the existing downstream hydrogen sulphide removal sections. Further advantages of the present process will become apparent when reading the detailed description of this invention.

The present process is directed to separate slag particles from a process for the preparation of synthesis gas by partial combustion of finely dispersed solid carbon-containing fuel with an oxygen-containing gas. Examples of carbon-containing fuel are coal, peat, wood, coke, for example petroleum coke, soot, carbon containing waste, biomass and mixtures of these. Mixtures of the aforementioned feed-stocks and metal containing waste streams can also be used as feed.

The ratio of volume of water poor in slag, which is extracted from the second vessel, relative to the volume of solids passing conduit from the first vessel to the second vessel in the same time period is preferably between 0.7 and 1.5 and more preferably between 0.8 and 1. Most preferably the volume of liquid extracted from the second vessel and supplied to the first vessel is about the same as the volume of solids passing from the first to the second vessel due to gravity. The liquid in the connecting conduit between first and second vessel will then be kept close to stagnant. This situation further reduces any sulphur compounds from entering the second vessel.

Preferably the mass flux of the slag particles in the connecting conduit between the first and second vessel is between 100–150 kg slag particles per square meter of the cross sectional area of the conduit or valve, whatever the smallest, per second ($kg/m^2/s$).

Because a first vessel is present between the quench zone and the second vessel or lockhopper a gradient in the concentration of sulphur compounds will be present, wherein the concentration of sulphur compounds in the first vessel will be lower than in the quench zone. This concentration gradient is especially achieved when the height over diameter ratio of the first vessel is greater 5 than three. Preferably the water poor in slag extracted from the second vessel is fed to the lower end of the first vessel to further increase this concentration gradient. This concentration gradient is advantageous because it further reduces the chances of any sulphur compounds entering the second vessel.

The volume of the first vessel is preferably of the same size or larger than the second vessel. The additional volume acts as buffer capacity for problem solving and in addition reduces the chances of any sulphur compounds entering the second vessel. When closing the first vessel from the second vessel in step (c) preferable no or very few slag particles will be present in the connecting conduit, thereby reducing the chance that slag particles obstruct the valve present in said conduit, thereby reducing the change on damaging the valve, and keeping the buffer capacity available to anticipate for problems that may rise. The second vessel is preferably not too small because this will result in a too high sluicing frequency, resulting in a poor capacity of the process. Suitably the volume of the first vessel is between 2 and 3 times the volume of the second vessel. The volume of the second vessel will be determined by the required capacity to remove slag particles. One skilled in the art can easily determine the optimal volume taken into account the required time to conduct steps (a)–(e) and the desire to minimize the size of the vessels.

By extracting relatively clean water from the second vessel a sort of suction is achieved which predominantly pulls the solids from the first vessel to the second vessel. The second vessel must be large enough to enable the solids to settle sufficiently during step (b) in order to achieve a region which is poor in solids and a lower region which is rich in solids.

In order to further reduce the amount of sulphur compounds which can be discharged from the first vessel to the second vessel it is advantageous to fill the second vessel with clean or fresh water after the slag particles are removed from the second vessel in step (d) and/or in step (e) before performing step (a). When slag particles enter the second vessel part of this clean water, having suitably about the volume of the entering particles, is discharged to the first vessel, or alternatively, but less preferred, to another outlet. When this clean water enters the first vessel a further reduction in this first vessel of the content of sulphur compounds results as also discussed above.

In a preferred embodiment of the present invention the first vessel is also provided with means to discharge water poor in slag. This is advantageous because slag particles can then more easily enter the first vessel from the quench zone as is described in GB-A-2086931. This water can advantageously be used as medium to cool the quench zone by extracting heat from this stream against cooling water, cooling air or another medium. Also it may be advantageously to use this water to destroy and/or clean deposits formed on the surface of the water layer present in the quench zone and deposits present on the quench zone construction itself. It may be advantageous to bleed some of this stream to prevent building up of contaminants. The preferred position at which the water poor in slag is discharged from the first vessel is the same as discussed for the second vessel.

The present process is very advantageous to be used in a situation wherein the pressure in the first vessel is higher than the pressure of the environment into which the separated solids are discharged to from the second vessel. In a gasification process the pressure in the quench zone and the associated first vessel in the process according the invention, is typically between 20 and 60 bars, while the solids are normally discharged at about ambient pressure from the second vessel, sometimes referred to as lockhopper vessel.

The Figure represents an apparatus for performing the above described preferred embodiment of the process according to the present invention. The apparatus comprises a first vessel (1), a second vessel (2), preferably positioned below the first vessel, and a first (3) and second (4) conduit fluidly connecting the first and second vessel. The first conduit (3) is preferably located such that slag particles in step (b) can move by gravity from the first vessel (1) to the second vessel (2). Second conduit (4) is provided with pumping means (5) to transport water poor in slag particles from the second vessel to the first vessel. Suitable means to pump a liquid are for example a gear pump, a lobe pump, a rotary pump, a centrifugal pump or a riser. The inlet of second conduit (4) is located such that water which is poor in slag particles is pumped from the second vessel (2) into the first vessel (1). Slag particles entering second vessel (2) via conduit (3) will accumulate in the lower part of the second vessel resulting in that the upper part of the second vessel is poor in slag particles relative to the lower part.

Preferably the inlet (6) of conduit (4) is therefore located in the upper part of the second vessel (2) and away from the outlet opening (8) of the first conduit (3) entering the second vessel (2). More preferably a tubular shield (7) is present around the outlet (8) of conduit (3) which directs the slag particles entering the second vessel (2) downwards and away from the inlet (6) of the second conduit (4). The second vessel is furthermore provided with an outlet opening (9) through which solid particles can be discharged and the first vessel is provided with an inlet opening (10) for receiving the mixture from the quench zone (14). The opening (10) may optionally be provided with a slag grinder to break large slag particles before entering the first vessel. If no slag grinder is present the opening (10) will typically be larger than the opening in the conduit connecting the first (1) and second (2) vessel, thereby enabling a trouble free flow of slag particles into the first vessel (1) from the quench zone (14).

The Figure also shows valves (11, 13) present in conduits (3) and (9) in order to operate the process in a sluice mode according to the present invention. In step (c) valve (11) is closed and pump (5) is stopped. In step (d) valve (13) is in a open position to discharge the slag particles from the second vessel (2). The Figure also shows a discharge zone (12).

The Figure also shows a conduit (15) through which water poor in slag can be removed from the first vessel and a tubular shield (16) which has the same functionality as shield (7) described in the second vessel.

The invention shall be illustrated by the following non-limiting Examples.

EXAMPLE 1

In an experimental set-up as illustrated in FIG. 2 vessel 1 was loaded with a mixture of water and 172 kg slag obtained from a coal gasification process having a density of 2335 kg/m$^3$. Most slag particles were present at the bottom of vessel 1 near valve 11. Vessel 2 was loaded with clean water. After opening of valve 11, having a diameter of 10 cm, and after start-up of pump 5 a stable sluicing flow through the valve was observed. The pump flow rate was 15.5 liter/minute and the 172 kg of slag was sluiced out in 3.65 minutes. The ratio of volume of liquid which is transported from the second vessel to the first vessel via conduit (4) relative to the volume of solids passing conduit (3) in the same time period is in this example thus 0.75.

EXAMPLE 2

Example 1 was repeated except that the pump flow was 36.3 liter/minute. The same 172 kg of slag was sluiced out in 2.44 minutes. The ratio of volume of liquid which is transported from the second vessel to the first vessel via conduit (4) relative to the volume of solids passing conduit (3) in the same time period is in this example 1.18.

Comparative Experiment A

Example 1 was repeated except that pump 5 was not used. The flow through valve 11 was very unstable and the experiment was repeated 15 times in order to obtain a reliable test result. On average it took the 172 kg of slag 5.6 minutes to pass valve 11.

The above experimental results show that by using the process according to the invention a high flow of slag can be transported from an upper vessel to a lower vessel while minimizing the amount of water being transported from said upper vessel to said lower vessel.

What is claimed is:

1. Process to remove solid slag particles from a mixture of solid slag particles and water present in a quench zone, which quench zone is part of a process for the preparation of synthesis gas by partial combustion of finely dispersed solid carbon-containing fuel with an oxygen-containing gas, by (a) discharging the mixture from the quench zone to a first vessel defined by a height to diameter ratio and equipped with conduit means for removing water that is poor in slag particles, (b) discharging slag particles from the first vessel to a second vessel by means of gravity, wherein the second vessel is located below and fluidly connected to said first vessel by means of an open connecting conduit and is further provided with closed means to discharge slag from a lower end of the second vessel, (c) discharging water poor in slag particles from the second vessel via a conduit provided with pumping means and having an inlet located such that the water poor in slag particles is pumped from the second vessel, (d) fluidly closing the first vessel from the second vessel, (e) opening the means to discharge slag from the second vessel to remove slag from the second vessel to a lower pressure zone, (f) closing the means to discharge slag from the second vessel;

(g) discharging the mixture from the quench zone to the first vessel;

(h) discharging slag particles from the first vessel to the second vessel by means of gravity;

(i) discharging water poor in slag particles from the second vessel via the conduit provided with pumping means such that the water poor in slag particles is pumped from the second vessel;

(j) fluidly closing the first vessel from the second vessel;

(k) opening the means to discharge slag from the second vessel to remove slag from the second vessel to a lower pressure zone, and (l) closing the means to discharge slag from the second vessel.

2. Process according to claim 1, wherein the water poor in slag obtained in step (c) is supplied to the first vessel.

3. Process according to claim 2, wherein the water poor in slag is supplied to the lower end of a first vessel, which first vessel has a height over diameter ratio of more than three.

4. Process according to claim 1, wherein the water, which is poor in solids, is discharged from the upper part of the second vessel at a position way from the outlet opening of the first conduit entering the second vessel.

5. Process according to claim 4, wherein a tubular shield is present around the outlet opening of the first conduit directing the slag particles entering the second vessel downwards and away from the inlet of the conduit through which water poor in slag particles is pumped from said second vessel.

6. Process according to claim 1, wherein the ratio of volume of water, which is extracted from the second vessel, relative to the volume of solid slag particles being transported to the second vessel in the same time period is between about 0.7 and 1.5.

7. Process according to claim 6, wherein the ratio is between 0.8 and 1.

8. Process according to claim 6, wherein the volume of water extracted from the second vessel is equal to the volume of slag particles being transported to the second vessel.

9. Process according to claim 1, wherein fresh water is supplied to the second vessel during step (e) and/or (f) resulting in that the second vessel contains fresh water before step (b) is performed.

10. Process according to claim 1, wherein water poor in slag is discharged from the first vessel.

* * * * *